US006517474B2

(12) United States Patent
Pascual

(10) Patent No.: US 6,517,474 B2
(45) Date of Patent: Feb. 11, 2003

(54) METHOD FOR MAKING A MINIATURE KITE

(76) Inventor: Ricardo Pascual, 385 Tavernier Cir., Oldsmar, FL (US) 34677

( * ) Notice: Subject to any disclaimer, the term of this patent is extended or adjusted under 35 U.S.C. 154(b) by 0 days.

(21) Appl. No.: 09/682,274

(22) Filed: Aug. 13, 2001

(65) Prior Publication Data

US 2001/0053738 A1 Dec. 20, 2001

Related U.S. Application Data

(63) Continuation-in-part of application No. 09/506,891, filed on Feb. 18, 2000, now Pat. No. 6,283,816.

(51) Int. Cl.[7] ..... B31D 5/00
(52) U.S. Cl. ..... 493/480; 493/393; 493/959
(58) Field of Search ..... 493/959, 480, 493/939, 955, 453, 393; 273/155; 446/67, 80; 206/475

(56) References Cited

U.S. PATENT DOCUMENTS 1,105,058 A * 7/1914 Bochau
2,134,403 A * 10/1938 Holland
2,344,693 A * 3/1944 Gade
3,697,023 A * 10/1972 Jackson
4,383,667 A * 5/1983 Weathers
4,805,853 A * 2/1989 Battles
4,871,133 A * 10/1989 Alonso
5,000,401 A * 3/1991 Barone
5,027,539 A * 7/1991 Orsini
5,127,611 A * 7/1992 Payne et al.
5,842,630 A * 12/1998 Remer

* cited by examiner

*Primary Examiner*—John Sipos
*Assistant Examiner*—Sameh Tawfik
(74) *Attorney, Agent, or Firm*—Ronald E. Smith; Smith & Hopen, P.A.

(57) ABSTRACT

13A miniature, highly decorative kite that flies indoors or outdoors is made by cutting a small piece of tissue paper into any preselected shape, including the shape of a standard diamond-shaped kite. Very finely cut bamboo sticks serve as the frame of the miniature kite and are adhered to a first side of the kite body to form a frame that maintains the preselected shape. Two elongate ribbons are secured to one another at their respective leading ends and are secured to the trailing end of the kite body. A string is attached to the apex of a triangular flap that is adhered to a second side of the kite body. The flap is folded at its base so that it lies in a plane perpendicular to the kite body when functioning. The kite flies in the slightest breeze and may be flown indoors.

7 Claims, 4 Drawing Sheets

METHOD FOR MAKING A MINIATURE KITE

CROSS-REFERENCE TO RELATED DISCLOSURES

This disclosure is a continuation-in-part of an earlier disclosure filed Feb. 18, 2000 by the same inventor, Ser. No. 09/506,891, now U.S. Pat. No. 6,283,816, entitled "Miniature Kites And Method For Making Them," which is hereby incorporated by reference into this disclosure:

BACKGROUND OF THE INVENTION

1. Field of the Invention

This invention relates, generally, to a method for making a miniature kite. More particularly, it relates to a method that ensures the kite will fly in an optimal manner.

2. Description of the Prior Art

Kites and construction techniques for making them are well known but there are a number of problems with such construction methods when the size of the kite is reduced to approximately the size of an index card.

A very small kite has utility as a novelty item because, unlike a full-size kite, it can be flown indoors. Those who have office jobs cannot enjoy full size kites during working hours. However, a miniature kite can be tethered to a small portable fan, or other source of blowing air, and enjoyed by office workers. A gaily-colored miniature flying kite with long flowing tails in flight is as delightful indoors as is a full-sized kite when flown outdoors. Accordingly, a miniature kite flying in an office has great stress-reducing qualities, and provides an aesthetically pleasing, mobile display that enlivens a sterile office or cubicle environment.

The construction of a small, very light-in-weight kite, however, is somewhat problematic. For example, it is difficult to accurately attach the kite line to the kite tab and the kite tab to the kite body. A nimble-fingered worker can do the job quite well, but it is difficult to maintain the same consistent quality of work throughout a workday. Moreover, the attaching of the kite line or string to the kite tab is a critical positioning, as is the positioning of the kite tab to the kite body.

What is needed, then, is an improved method for making a miniature kite. The needed method should produce miniature kites of consistently high quality, should make the assembler's job easy, and should lower the level of skill required to perform the assembly task. Moreover, the quantity of kites that could be manufactured per hour should be high so that the cost of each kite to the consumer could be low.

There is also a need for a miniature kite that is aerodynamically designed so that it may also be flown indoors and outdoors in a very low speed breeze.

However, at the time the present invention was made, it was not obvious to those of ordinary skill in the kite-making art how an ideal miniature kite could be constructed.

SUMMARY OF INVENTION

This inventive method is new, useful and nonobvious. The novel method for making a miniature kite includes the steps of forming from tissue paper a kite body of predetermined configuration. The kite body has a longitudinal axis of symmetry, a transverse axis, a leading end and a trailing end. At least a firs t elongate support member is secured to a first side of the kite body and a t least a second elongate support member is secured to said first side of said kite body as well. A tab or flap member of triangular configuration is also formed from tissue paper and secured to the kite body at a critical location. The flap member has an apex opposite from a longest side of the triangle.

A preselected edge of the flap member is secured to a second side of the kite body in parallel, spaced apart relation to the longitudinal axis of the kite body. The flap member is folded to position an unsecured part of the flap member in a flap plane substantially normal to a plane of the kite body. The flap plane passes through the longitudinal axis of symmetry of the kite body. The flap member is positioned so that the apex is positioned between the leading end of the kite body and a preselected transverse axis of the kite body, and in predetermined spaced relation to a plane of the kite body when the flap is deployed normal to the kite body.

An elongate thread is wound about a card and a free end of the thread is secured to an apex of the flap member. The card supplants a conventional dowel pin of the type commonly used for storing a kite string. Use of a flat, light-in-weight card reduces production time, material cost, and shipping expenses. It also enables a user to play out and collect lengths of kite string more efficiently than when using a dowel pin. Moreover, it facilitates the removal of the novel kite from its package and the re-packaging of the kite as well.

An elongate tail means is then secured to the trailing end of a preselected side of the kite body, and the completed assembly is prepared for shipping.

In a preferred embodiment, the predetermined configuration of the kite body is a diamond configuration. In additional embodiments, the predetermined configuration is triangular, star-shaped, rectangular, or oval. Other geometric shapes are within the scope of this invention because the shape of the kite body is not the innovative part of the invention.

It is therefore understood that a primary object of this invention is to provide fast and efficient means for making miniature kites of consistently high quality.

A closely related .object is to lower the skill level required for miniature kite assembly so that such kites can be economically produced.

Another important object is to make a miniature kite from very lightweight materials so that it can fly in very low air movement conditions.

Yet another highly significant object is to provide a miniature kite having optimal aerodynamic properties.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
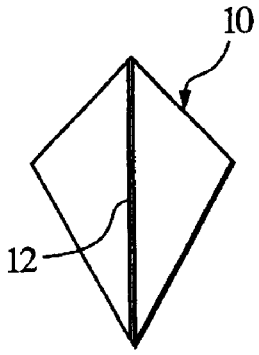
FIG. 1 is a top plan view of a kite body formed of tissue paper after a first frame member has been secured thereto.

Referring now to FIG. 1, it will there be seen that the preferred embodiment of the miniature kite body of this invention is denoted as a whole by the reference numeral 10. Like standard kite bodies, it is substantially diamond-shaped, having a longitudinal extent that exceeds its transverse extent. The preferred longitudinal extent is about four and nine-sixteenths inches and the preferred transverse extent is about three and five-sixteenths inches.

The assembly table should be rotatable about a vertical axis, should have a dark color to contrast with the white glue used in the manufacturing process, and should be made of a material such as glass, Formica® or Plexiglas®.

In FIG. 1, a bamboo stick 12 is adhered to a first side of kite body 10. Stick 12 is coincident with the longitudinal axis of symmetry of said kite body. Although the step of adhering bamboo stick 12 to kite body 10 might be accomplished by any suitable means, the preferred technique is to prepare white glue that has been diluted, and to brush that watered-down white glue onto a first side of bamboo stick 12, being careful to apply the glue for the entire length of the stick. Another way to apply the glue is to grasp the stick with a pair of tweezers and to swipe the stick from one end to the other through a glue spot on the assembly table or through a flat-surfaced tray, thereby eliminating the need for a brush, increasing production, and facilitating glue application. Undiluted (full strength) glue is too thick for easy application to either the stick or the paper and wrinkles the tissue paper from which kite body 10 is made. Stick 12 is then positioned, while still holding it with tweezers, on the kite body in alignment with the longitudinal axis thereof as indicated in FIG. 1. If the stick is bowed, it is a simple matter to straighten it before the glue dries by nudging it with a finger until it is straight. The stick is pressed lightly to promote adhesion, and the glue is allowed to cure.

Figure 2:
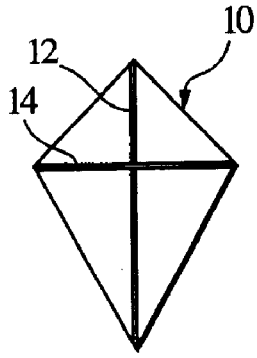
FIG. 2 depicts the kite body of FIG. 1 after a second frame member has been secured thereto.

A second, transversely disposed bamboo stick 14 is then adhered in the same manner to the kite body as depicted in FIG. 2, i.e., in alignment with the largest or maximum-size transverse axis of the kite body. If either or both bamboo sticks have a slight warp or curvature, then the convex side of the warp or curvature is disposed against the kite body to optimize the shape thereof for flying. Sticks 12 and 14 collectively form a frame that maintains the shape of the kite body.

To attach triangular-shaped tab or flap 32, kite body 10 is inverted so that the side thereof to which bamboo sticks 12, 14 are adhered is facing down on the assembly table. A coin or clean pebble is placed on the kite body to prevent it from blowing away during the remaining steps of the method.

Figure 3A:
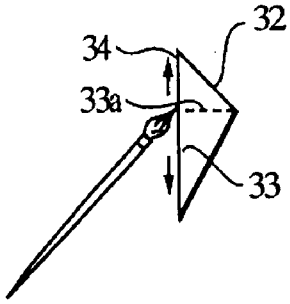
FIG. 3A depicts the step of applying an adhesive to a flap.

A narrow strip of adhesive 33 is applied to long edge 34 of flap 32 as indicated in FIG. 3A; the width of the adhesive strip is about one-eighth of an inch. However, as a practical matter, it is advantageous to apply narrow strip of adhesive 33 to kite body 10 instead of to flap 32. Kite body 10 is larger and more stable than flap 32 when lying on a table so the application of adhesive 33 to such kite body is easier and faster than applying said adhesive to flap 32 as depicted.

Although a brush is depicted in FIG. 3A, it should be understood that use of a plastic applicator has some advantages over a brush. For example, a plastic applicator is superior to a brush when applying a clean thin line of adhesive to a surface. Accordingly, when applying adhesive to the kite body in preparation to attaching flap 32 to said kite body, a plastic applicator can make the strip of adhesive precisely the length of the flap edge and can position the strip of adhesive very close to vertical stick 12. A mark such as a "<" can also be made on handle of a plastic applicator and used to indicate the vertical position of flap 32 relative to horizontal bamboo stick 14. Throughout this disclosure, it should be understood that all references to a brush should be interpreted as including a plastic applicator as well.

Figure 3B:
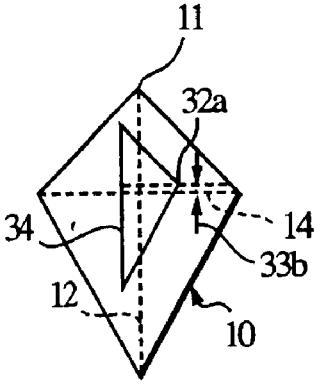
FIG. 3B depicts the attachment of the flap to the kite body.

The glued edge of triangular flap 32 is pressed against the stick-free side of kite body 10, in parallel but slightly offset relation to the longitudinal axis thereof, as depicted in FIG. 38. More particularly, long edge 34 of flap 32 is positioned slightly to the left or right of longitudinal stick 12 (which is on the opposite side of kite body 10), depending upon the dominant handedness of the assembler, so that when the unglued part of flap 32 is folded along its glued edge, the main body of said flap is oriented normal to the plane of kite body 10 and in a plane coincident with the longitudinal axis of symmetry of said kite body. Specifically, long edge 34 is positioned between one-sixteenth to one-eighth of an inch from said longitudinal axis. The top of the flap is positioned about three-quarters of an inch from leading end 11 of kite body 10. This positions apex 32*a* of triangular flap 32 about one-eighth to one-fourth of an inch above transverse stick 14. As used herein, the term "above " means on the side of transverse stick 14 nearest said leading end. The leading end of kite body 10 is the top end thereof, as drawn in FIG. 3B, and is denoted 11 as aforesaid.

The positioning of said apex 32*a* about one-eighth to one-fourth of an inch from transverse stick 14, on the leading side thereof, is of critical importance. This distance is denoted 33*b* in FIG. 3B. This represents a critical positioning of said apex because it optimizes the aerodynamic features of the novel kite. For example, if apex 32*a* of triangular flap 32 were coincident with transverse stick 14, i.e., if distance 33*b* were zero, the flight characteristics of the novel kite would be diminished vis a vis the optimal positioning disclosed herein. Since the one-eighth to one-fourth inch separation between apex 32*a* of triangular flap 32 and transverse stick 14 is optimal only for the specific size kite body mentioned above, it is clear that such distance would increase as the size of kite body 10 is increased and decrease as said size is reduced. In the broadest claim that follows this description, the apex of the triangular flap is recited as being between the leading end of the kite body and the longest transverse axis of the kite body. Transverse stick 14 is coincident with said longest transverse axis as mentioned earlier. When the kite is in use, flap 32 is positioned normal to the plane of kite body 10. Apex 32*a* is between leading end 11 of kite body 10 and the longest transverse axis 14 as aforesaid, but is spaced from the plane of kite body 10 by a distance predetermined by the size of flap 32, which size is of course variable. The triangular shape of flap 32 may be divided by an imaginary line into two right triangles as indicated by imaginary line 33*a* in FIG. 3A. Apex 32*a* is thus understood to be spaced from the plane of kite body 10 by a distance equal to the length of imaginary line 33*a* when flap 32 is in its deployed, in flight position.

Figure 5:
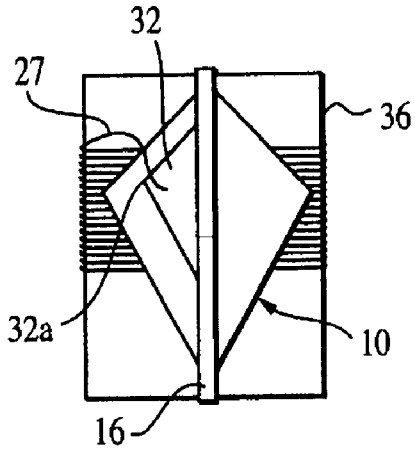
FIG. 5 depicts how the kite is prepared for shipment.

About forty (40) yards of thread is wound in a uniform manner around a relatively stiff 3½"×5" inch card, preferably made of pressboard, denoted 36 in FIG. 5, on a thread-winding machine designed by the present inventor.

Figure 3C:
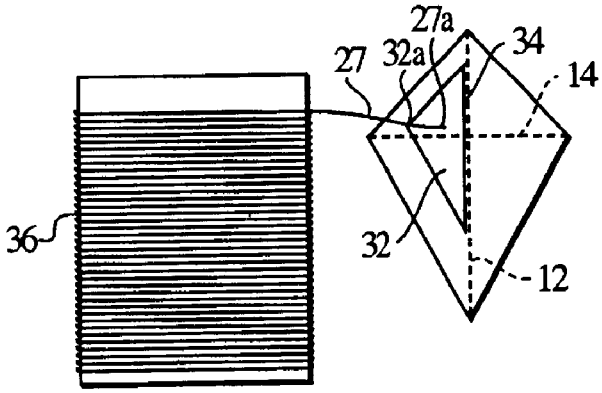
FIG. 3C depicts the step of attaching a free end of a kite thread to the flap.

After flap 32 has been secured to kite body 10, a free end of thread 27 is adhered to apex 32*a* of flap 32 as depicted in FIG. 3C. Diluted white glue is applied by any suitable means to free end 27*a* of thread 27 for an extent of about one-half of an inch, and said glue-covered free end is then placed into overlying relation to flap 32 at apex 32*a*. Although flap 32 could have a shape other than triangular, the use of a triangular-shaped flap has the advantage that it provides a clear apex to which thread 27 is attached. This removes all guesswork from the kite assembly and positions thread 27 at its optimal position.

The preferred embodiment of the novel miniature kite includes two tail ribbons, although different numbers thereof are within the scope of this invention. The ribbons are made of the same light-in-weight material as the kite body and flap. Each ribbon is preferably about nine-sixteenths of an inch in width and about thirty inches in length. A second pair of kite tails is provided in each kit of the commercial embodiment of the invention, for use in high winds. Specifically, the respective leading ends of the second pair of tails are attached to the respective trailing ends of the primary tails in such circumstance.

Figure 4A:
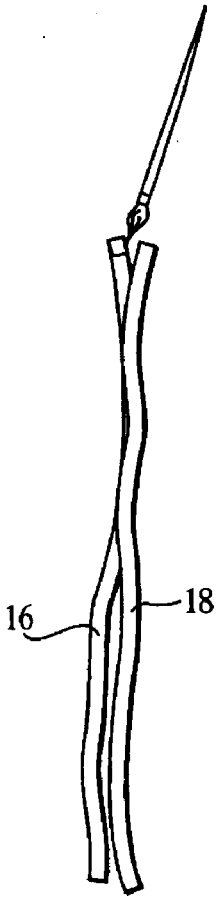
FIG. 4A depicts the first step in a kite tail-attaching method.
Figure 4B:
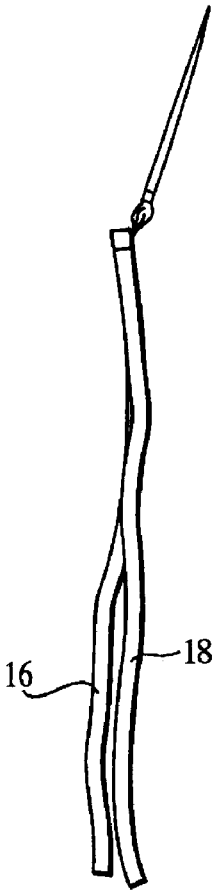
FIG. 4B depicts the second step in said tail-attaching method.
Figure 4C:
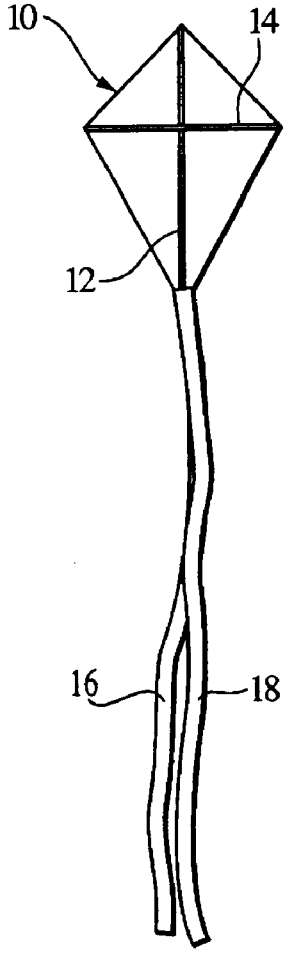
FIG. 4C depicts the third step in said tail-attaching method.

The ribbon attaching procedure is depicted in FIGS. 4A, 4B, and 4C. As indicated in FIG. 4A, the diluted glue is applied by a suitable brush means or plastic applicator to a first end of one of the ribbons; the glue extends from the leading end of ribbon 16 to a point about one-quarter inch from said end. The leading end of ribbon 1 8 is then pressed thereagainst and the two ribbons are joined to one another when the glue sets. The brush or plastic applicator is then used again to apply glue to an exterior surface of either ribbon, as indicated in FIG. 4B. This glue extends from the end of the ribbon to a point about one-quarter inch from said end. The glued end of the ribbon is then pressed against kite body 10 at its trailing end as indicated in FIG. 4C and the tail connecting procedure is finished when the glue cures. It is important to apply the tails squarely so that their respective longitudinal axes of symmetry are coincident with the longitudinal axis of symmetry of the kite.

However, it has been found that an easier, faster and more accurate tail-attaching method is to lay a plurality of tails on the assembly table, apply glue to the tails with the plastic applicator, and to place the kite body—stick side down—onto the tails. This allows for a more accurate placement and alignment of the kite body to and with the tails so that they are squared relative to the longitudinal axis of the kite main body and in line with one another.

In the preferred embodiment, each ribbon of the ribbon pair is of a different color for artistic purposes.

The miniature kite is prepared for shipping by placing it into overlying relation to card 36 as depicted in FIG. 5. Ribbons 16, 18, that form the kite tail are coiled around the card as shown. Card 36 provides ease of packaging, and facilitates packaging of the kite by the manufacturer and carrying and use of the kite by the consumer. In a commercial embodiment, an extra set of tails is provided for use in high wind conditions as mentioned earlier.

Figure 6A:
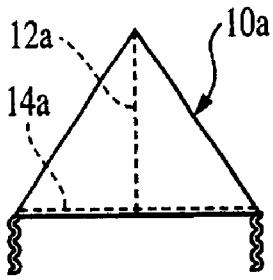
FIG. 6A depicts a kite body of triangular configuration.
Figure 6B:
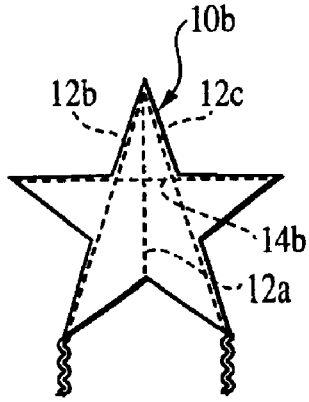
FIG. 6B depicts a kite body of five-pointed star configuration.
Figure 6C:
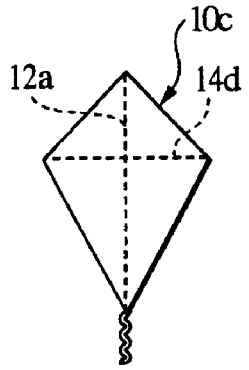
FIG. 6C depicts a kite body of substantially diamond-shaped configuration.
Figure 6D:
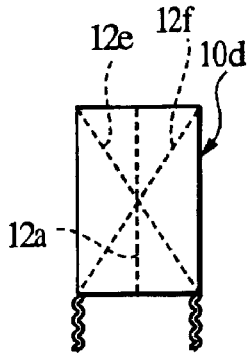
FIG. 6D depicts a kite body of rectangular configuration.
Figure 6E:
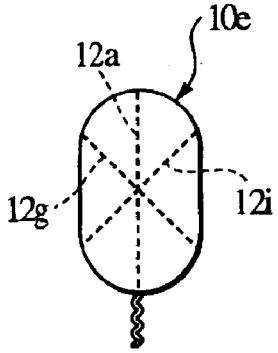
FIG. 6E depicts a kite body of substantially oval configuration.
Figure 6F:
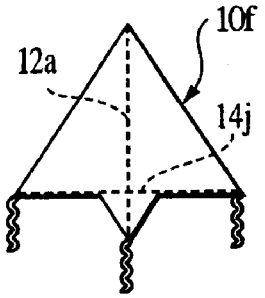
FIG. 6F depicts a kite body of substantially triangular configuration.
Figure 6G:
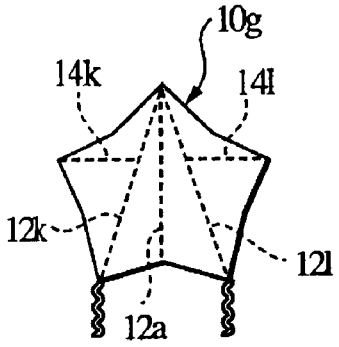
FIG. 6G depicts a kite body of substantially five-pointed star configuration.

The novel procedures disclosed above may be employed to make kites of widely varying shapes, and the coverage of this invention extends to kites of all shapes and sizes. For example, as depicted in FIG. 6A, kite body 10*a* may have a triangular shape and the frame that maintains that shape may include a longitudinally disposed first stick 12*a* and a transversely disposed second stick 14*a*. As depicted in FIG. 6B, kite body 10*b* may have the configuration of a five-pointed star and in such event the frame for maintaining that shape would include sticks 12*a*, 12*b*, 12*c*, and 14*b*. FIG. 6C depicts kite body 10*c* of substantially diamond-shaped configuration, and its frame includes sticks 12*a* and 14*d*. Rectangular kite body 10*d* is depicted in FIG. 6D and its frame includes sticks 12*a*, 12*e* and 12*f* arranged in an "X " configuration. An oval kite body is denoted 10*e* in FIG. 6E and its frame preferably includes three sticks 12*a*, 12*h* and 12*i* arranged in the pattern of an asterisk. FIG. 6F depicts a substantially triangular kite body 10*f* having a frame formed by sticks 12*a* and 14*j*. Finally, a modified five-pointed star kite body 10*g* is depicted in FIG. 6G, and its frame is formed by sticks 12*a*, 12*k*, 12*l* and 14*k*, 14*l*. Numerous other shapes and appropriate frames therefore are within the scope of this it being impractical to illustrate all other practical miniature kite designs made possible by this invention.

Note further that the embodiments of FIGS. 6A, 6B, 6D, and 6G are double-tailed, and the embodiment of FIG. 6F may be double or triple-tailed.

It will be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A method for making a miniature kite, comprising the steps of:

forming from tissue paper a kite body of predetermined configuration, said kite body having a longitudinal axis of symmetry, a transverse axis, a leading end and a trailing end;

securing at least a first elongate support member to a first side of said kite body;

securing at least a second elongate support member to said first side of said kite body;

forming from tissue paper a flap member of triangular configuration, said flap member having an apex opposite from a longest side of said triangle;

securing a preselected edge of said flap member to a second side of said kite body in parallel relation to said longitudinal axis of said kite body, said preselected edge of said flap member being spaced apart from said longitudinal axis by a predetermined distance;

folding said flap member to position an unsecured part of said flap member in a flap plane substantially normal to a plane of said kite body, said flap plane passing through said longitudinal axis of symmetry of said kite body; and positioning said flap member so that said apex is positioned between said leading end and a preselected transverse axis of said kite body, said apex being spaced from said preselected transverse axis by about one-eighth to one-fourth inch and in predetermined spaced relation to a plane of said kite body when said flap is deployed normal to said kite body;

securing a free end of a kite thread to an apex of said flap member; and securing an elongate tail means to a trailing end of a preselected side of said kite body.

2. The method of claim 1, wherein said predetermined distance is about one-sixteenth to one-eighth inch.

3. The method of claim 1, wherein said step of forming from said tissue paper a kite body of predetermined configuration includes the step of forming from said tissue paper a kite body of diamond-shaped configuration, and wherein the step of securing at least a first elongate support member to said kite body includes the step of securing an elongate support member to said kite body along the longitudinal axis of said kite body and wherein the step of securing at least a second elongate support member to said kite body includes the step of securing an elongate support member to said kite body along a maximum extent transverse axis thereof.

4. The method of claim 1, wherein said step of forming from said tissue paper a kite body of predetermined configuration includes the step of forming from said tissue paper a kite body of diamond-shaped configuration, securing a first elongate support member to said first side of said kite body in registration with a longitudinal axis of symmetry of said substantially diamond-shaped kite body, and securing a second elongate support member to said first side of said substantially diamond-shaped kite body in registration with a transverse axis of said substantially diamond-shaped kite body so that said first and second elongate support members are disposed at a substantially right angle to one another.

5. The method of claim 1, wherein said step of forming from said tissue paper a kite body of predetermined configuration includes the step of forming from said tissue paper a kite body of five-pointed star configuration, and securing first, second and third elongate support members to said first side of said kite body to form a frame that maintains said substantially five-pointed star configuration.

6. The method of claim 1, wherein said step of forming from said tissue paper a kite body of predetermined configuration includes the step of forming from said tissue paper a kite body of rectangular configuration, and securing first and second elongate support members to said first side of said rectangular kite body in an "X" pattern to form a frame that maintains said rectangular configuration.

7. The method of claim 1, wherein said step of forming from said tissue paper a kite body of predetermined configuration includes the step of forming from said tissue paper a kite body of oval configuration, and securing first, second, and third elongate support members to said first side of said oval kite body in an asterisk pattern to form a frame that maintains said substantially oval configuration.

* * * * *